United States Patent [19]

Huston et al.

[11] Patent Number: 5,016,888

[45] Date of Patent: May 21, 1991

[54] MAGNETIC GAME SYSTEM

[75] Inventors: Donald B. Huston, Menasha; William L. Rackow, Appleton, both of Wis.

[73] Assignee: George Banta Co., Inc., Menasha, Wis.

[21] Appl. No.: 238,014

[22] Filed: Aug. 29, 1988

[51] Int. Cl.[5] ..... A63F 3/00

[52] U.S. Cl. ..... 273/239; 273/282; 428/900

[58] Field of Search ..... 273/239, 282 A, 1 M, 273/286; 428/900

[56] References Cited

U.S. PATENT DOCUMENTS

| | | | |
|---|---|---|---|
| 3,093,919 | 6/1963 | Holtz | 273/239 |
| 3,619,313 | 11/1971 | Sruch | 273/239 |
| 4,049,275 | 9/1977 | Skelton | 273/239 |
| 4,664,734 | 5/1987 | Okita et al. | 156/231 |
| 4,664,964 | 5/1987 | Okita et al. | 428/143 |

FOREIGN PATENT DOCUMENTS

| | | | |
|---|---|---|---|
| 0109673 | 5/1984 | Japan | 273/239 |
| WO85/00528 | 2/1985 | PCT Int'l Appl. | 273/239 |
| 2150842A | 7/1985 | United Kingdom | 273/239 |

*Primary Examiner*—Benjamin Layno

*Attorney, Agent, or Firm*—Foley & Lardner

[57] ABSTRACT

An improved magnetic game system according to the invention includes a magnetically attractable layer which has the same shape as a game track on the board's surface. The magnetically attractable layer is made of, for example, particles such as iron particles dispersed in a layer of a cross-linked, flexible polymeric material, such as an acrylic resin. The resulting board has improved durability and may be economically manufactured.

8 Claims, 1 Drawing Sheet

MAGNETIC GAME SYSTEM

TECHNICAL FIELD

This invention relates to board games, particularly to board games in which the game pieces are releasably held to the board by magnetic attraction. The invention further concerns a method for manufacturing a game board having a built-in layer of a magnetically attractable substance.

BACKGROUND OF THE INVENTION

Many game systems have been proposed in which game pieces are held to a game board magnetically so that the position of the pieces on the board will not be accidently disturbed. This has been done, for example, by providing a magnetic substance in the pieces and a magnetically attractable substance in the board. Generally, a layer of foil or particles such as iron filings are sandwiched between adjacent layers of the board. The magnetic layer may be formed by a variety of methods, including sieve printing or silk screening. See, for example, Holtz U.S. Pat. No. 3,093,919, issued June 18, 1963, and Green U.K. Patent App. No. 2,150,842, published July 10, 1985. In the alternative, discrete spots on the board containing the magnetically attractable material may be formed by disposing the material in spaced-apart slots or recesses formed in the backing of the board. See, e.g., Szuch U.S. Pat. No. 3,619,313, issued Nov. 9, 1971, and Skelton U.S. Pat. No. 4,049,275, issued Sept. 20, 1977.

The board for such game systems generally includes a support or backing layer, such as cardboard, on which the magnetic layer is disposed, and a covering layer such as paper glued over the magnetic layer. The magnetically attractable material, such as iron oxide particles, may be dispersed in an adhesive binder. See, Holtz, noted above, and Roberts PCT App. No. WO 85/00528.

Such constructions have proven useful in providing "lap top" games, but nonetheless have certain disadvantages. Use of metal foil in such boards is expensive and potentially dangerous, insofar as the sharp foil edges can come loose if the board is damaged. Loose iron filings disposed in recesses tend to settle unevenly, leak out, and rust. Rusting is also a problem with iron particles which are poured onto a layer of adhesive, nor is the problem necessarily solved by distibuting the particles in a conventional adhesive. Such adhesive layers may also lack flexibility, so that the magnetic layer cracks when the board is bent. Finally, providing a magnetically attractable layer over the entire board is usually wasteful because the game pieces need to adhere only to certain areas of the board surface. The present invention addresses these problems.

SUMMARY OF THE INVENTION

An improved magnetic game system according to the invention includes a board having a built-in magnetically attractable layer which, according to one aspect of the invention, has the same shape as a game track printed on the upper surface of the board. According to another aspect of the invention, a game board has a magnetically attractable layer which is made of a flexible polymer having particles of a magnetically attractable material dispersed therein.

The invention further provides a method for making a game board wherein a magnetically attractable layer is formed on a backing in the shape of a game track. A covering layer is then adhered over the backing and magnetically attractable layer. A game track disposed on the covering game track coincides with the magnetically attractable layer, allowing magnetic game pieces to be secured thereto.

The invention additionally provides a magnetically attractable laminate useful for a variety of purposes made in essentially the same manner as the abovedescribed game board, as well as compositions useful for making such laminates, as described in detail hereafter.

BRIEF DESCRIPTION OF THE DRAWING

The invention will be further described with reference to the accompanying drawing, wherein like numerals denote like elements, and.

DETAILED DESCRIPTION OF A PREFERRED EMBODIMENT

Figure 1:
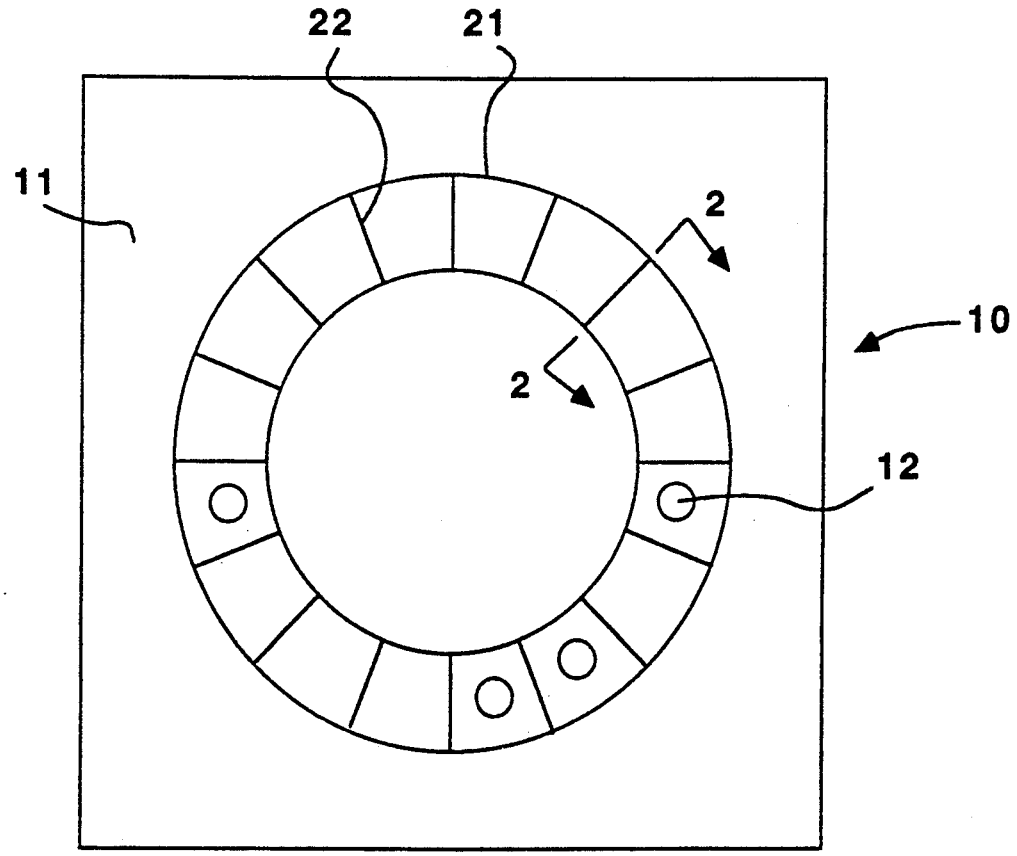
FIG. 1 is a top plan view of a game system according to the invention.

Referring to FIG. 1, a game 10 includes a board 11 and magnetic pieces 12. Pieces 12 may be of any desired size, shape, color or the like, and are preferrably magnetic. Magnetic game pieces or tokens of this type are well known and may be made from, for example, flexible rubberized magnetic material, or molded plastic having a magnet embedded therein or adhered thereto.

Figure 2:
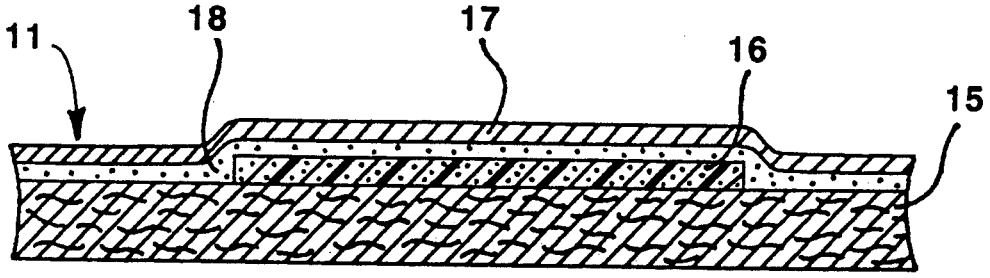
FIG. 2 is a partial sectional view taken along the line 2—2 in FIG. 1.

Referring now to FIGS. 1 and 2, board 11 comprises, in successive layers, a backing 15 made of cardboard, wood, plastic, or similar material, a magnetically attractable layer 16 described in detail hereafter, and a cover sheet 17, e.g. paper or latex-impregnated cloth, secured to both backing 15 and magnetically attractable layer 16 by an adhesive layer 18. "Magnetically attractable" as used herein means magnetic or made of a material attracted by a magnet, such as a ferrous material.

Cover sheet 17 generally has nearly the same dimensions as backing 15, so that layer 16 is completely enclosed within board 11. Cover sheet 17 has a game track 21 and other game information (not shown) printed thereon. Game track 21 comprises, for example, a series of adjacent squares 22 that form one or more pathways on which game pieces 12 move. The underside of cover sheet 17 is coated with layer 18 of an adhesive which has the ability to bond to the surfaces of both backing 15 and layer 16.

Magnetically attractable layer 16 is a thin coating of a cured (cross-linked) polymer in which small magnetically active particles are dispersed. The particles are preferrably elemental iron particles having an average size (largest dimension) in the range of from about 0.2 to 0.4 microns. Particles larger than about 0.4 microns render the step of forming layer 16 more difficult, e.g., have problems fitting through the screen openings during the printing step, and render the surface of layer 16 more uneven. Iron oxide particles can be used instead of iron particles, but are not preferred because they tend to discolor. Other magnetically attractable materials such as ferrosilicone powder, carbonized iron, and magnetic black powder can also be used.

Layer 16 has a thickness of at least about 0.1 mm, preferrably in the range of about 0.1 to 0.25 mm. If the thickness of layer 16 is less than about 0.1 mm, the amount of magnetically attractable material per unit area may be too low to hold the magnetic pieces sufficiently. A thickness greater than about 0.25 mm adds to the expense and bulkiness of the board without significantly improving its performance. The presence of layer 16 causes game track 21 to protrude slightly from the top surface of board 11, providing additional emphasis for track 21.

As the cross-linking polymer used in layer 16, an acrylic resin is preferred, although other plastics having similar characteristics could also be employed. The cross-linking polymer according to this embodiment of the invention forms an air-impermeable coating around iron particles, preventing them from rusting. The acrylic polymeric matrix is also flexible. This allows layer 16 to flex with board 11 without cracking.

Layer 16 may be readily formed on backing 15 by screen printing. For this purpose a water-based dispersion is prepared which generally comprises magnetically attractive particles dispersed in water, a plasticizer such as propylene glycol, and the uncured, dissolved polymer. Preferred approximate ranges for such a dispersion are as follows:

| Component | Preferred(wt. %) | Most Preferred(wt. %) |
|---|---|---|
| Magnetically attractable powder | 70–90 | 78–82 |
| Polymer | 4–15 | 6–11 |
| Plasticizer | 0–5 | 1–3 |
| Water | 4–15 | 6–11 |

Using this dispersion, screen printing allows a magnetically attractable layer to be selectively formed where the game track will be, but not at other locations. There is no need for layer 16 to cover the entire board 10. Similarly, the acrylic polymer adheres well to the upper surface of backing 15, and there is no need to precoat the surface of the cardboard. Additional water may be added to the dispersion later as needed to maintain the desired consistency.

Layer 16 is then heated and dried to cross-link the resin and remove the solvent (i.e., water). Cover sheet 17 may then be applied by coating the underside thereof with a suitable adhesive. A hot animal glue made of protein, cane sugar and water is especially suitable because it is non-toxic and adheres well to both backing 15 and layer 16. Many adhesives do not adhere well to layer 16, resulting in bubbles under cover sheet 17. The finished board may then be combined with other games components and packaged.

EXAMPLE

A mixture having a total weight of 500 pounds and having the following composition is initially prepared, amounts being in percent by weight:

| | |
|---|---|
| Electrolytic iron powder (0.3 micron average particle size) | 78.4 |
| Joncryl 88 (styrene-acrylic acid copolymer, aqueous solution) | 19.6 |
| Propylene glycol (plasticizer) | 2.0 |

The foregoing copolymer solution contains about 45–55% by weight copolymer dissolved in water and a small amount of a surfactant. This solution is initially mixed, and the plasticizer is then added thereto as mixing is continued. The iron powder is then gradually added over the course of 10–15 minutes, and the resulting mixture is further mixed for at least about 10 more minutes. The resulting composition has thereby been stirred to form a liquid having the iron particles dispersed therein. This liquid is then printed directly on flat piece of Davey board using conventional silk screening apparatus provided with a monofilament polyester screen (T120, 236 micron mesh). The resulting layer has a thickness of 0.005 inch, with an effective deposition of 0.2 grams iron/square inch. The layer is then dried by infrared heating.

A cover sheet pre-printed with a game track and other game board information is then coated with animal glue at about 140° F. The glue coating is sufficiently thin to avoid causing excess glue to leak out under the edges of the cover sheet after application to the board. The cover sheet is then applied over the backing and magnetically attractable layer and firmly adhered thereto by pressure.

A finished game board made according to the foregoing procedure was tested for durability by artificial aging. The board was left for 30 days at a temperature of 125° F. and a 90% relative humidity. At the end of the test period the board was examined. It remained flexible and free of rust.

It will be understood that the foregoing description is of preferred embodiments of the invention, and that the invention is not limited to the specific forms shown. For example, a laminate according to the invention may be used in other applications wherein movable magnetic material must be held to a surface, such as signs, toys and decorations. Such laminates are flexible and resilient, and thus may be slit, cut or drilled without chipping or shattering. Laminates according to the invention are also water resistant. These and other modifications may be made in the design and arrangement of the invention without departing from the scope thereof as defined in the appended claims.

We claim:

1. In a game system including a board and a plurality of pieces which may be releasably secured to the board by magnetic attraction, the improvement which comprises:

said board comprises a backing layer, a magnetically attractable layer disposed on said backing layer, said magnetically attractable layer consisting essentially of magnetically attractable metallic particles coated by and dispersed in a matrix of a cross-linked, flexible acrylic resin, a covering layer disposed on said magnetically attractable layer which completely covers said magnetically attractable layer, said covering layer having means defining a game track thereon, and means for securing said layers together, wherein said magnetically attractable layer underlies and has substantially the same shape as said game track, said magnetically attractable layer having a substantial thickness wherein only the portion of the covering layer containing the game track visibly protrudes from the surrounding top surface of the game board in order to make the game track more visually distinguishable from the rest of the top surface.

2. The game system of claim 1, wherein said particles are made of elemental iron.

3. The game system of claim 1, wherein said magnetically attractable layer has a thickness in the range of 0.1 to 0.25 mm.

4. The game system of claim 1, wherein said said particles have an average particle size in the range of 0.2 to 0.4 microns.

5. In a game system including a board and a plurality of pieces which may be releasably secured to the board by magnetic attraction, the improvement which comprises:

said board comprises a backing layer, a magnetically attractable layer disposed on said backing layer, a covering layer disposed on said magnetically attractable layer which completely covers said magnetically attractable layer, said covering layer having means defining game information thereon, and adhesive means for securing said layers together, wherein said magnetically attractable layer consists essentially of magnetically attractable particles containing iron dispersed in a matrix of a cross-linked polymer which forms an air-impermeable coating on said particles effective to inhibit rusting of said particles and cracking of said magnetically attractable layer during flexing of said board, said magnetically attractable layer having been formed by screen-printing a dispersion containing said polymer and said particles onto said backing layer, cross-linking said polymer, and drying said dispersion.

6. A game board for use in a game system including a board and a plurality of pieces which may be releasably secured to the board by magnetic attraction, comprising:

a backing layer;

a magnetically attractable layer disposed on said backing layer, which magnetically attractable layer consists essentially of magnetically attractable metallic particles coated by and dispersed in a matrix of a crosslinked, flexible acrylic resin a covering layer disposed on said magnetically attractable layer which completely covers said magnetically attractable layer, said covering layer having means defining game information on a portion of the game board surface, said magnetically attractable layer underlies and has substantially the same shape as said game information, said magnetically attractable layer having a substantial thickness wherein only the portion of the covering layer containing the game information visibly protrudes from the surrounding game board surface in order to make the game information more visually distinguishable from the rest of the game board surface;

and adhesive means for securing said layers together.

7. A game board for use in a game system including a board and a plurality of pieces which may be releasably secured to the board by magnetic attraction, comprising:

a backing layer;

a magnetically attractable layer disposed on said backing layer;

a covering layer disposed on said magnetically attractable layer which completely covers said magnetically attractable layer;

a game track defined on said covering, said game track comprising a series of adjacent squares forming a pathway on which game pieces move, and adhesive means for securing said layers together, wherein said magnetically attractable layer underlies and has substantially the same shape as said game track said magnetically attractable layer having a substantial thickness wherein only the portion of the covering layer containing the game track visibly protrudes from the surrounding top surface in order to make the game track more visually distinguishable from the rest of the top surface 8. In a game system including a board and a plurality of pieces which may be releasably secured to the board by magnetic attraction, the improvement which comprises:

said board comprises a backing layer, a magnetically attractable layer having a thickness in the range of 0.1 to 0.25 mm disposed on said backing layer, a covering layer disposed on said magnetically attractable layer which completely covers said magnetically attractable layer, a game track on said covering, said game track comprising a series of adjacent squares forming a pathway on which game pieces move, which pathway protrudes from the top surface of said game board by approximately the thickness of said magnetically attractable layer, and means for securing said layers together, wherein said magnetically attractable layer underlies and has substantially the same shape as said game track wherein only the portion of the covering layer containing the game track visibly protrudes from the surrounding top surface of the game board in order to make the game track more visually distinguishable from the rest of the top surface

* * * * *